US005837069A

United States Patent [19]

Deards et al.

[11] Patent Number: 5,837,069

[45] Date of Patent: Nov. 17, 1998

[54] CAST IRON COMPONENTS AND METHOD OF MAKING

[75] Inventors: Nicola Deards, Cheltenham, England; Mark Gavin Taylor, Spring Lake, Mich.

[73] Assignee: Weyburn-Bartel Inc., Grand Haven, Mich.

[21] Appl. No.: 932,139

[22] Filed: Sep. 16, 1997

[51] Int. Cl.[6] ..... C22C 37/00; C21D 5/00

[52] U.S. Cl. ..... 148/323; 148/545

[58] Field of Search ..... 148/323, 545

[56] References Cited

U.S. PATENT DOCUMENTS

| | | | |
|---|---|---|---|
| 4,482,396 | 11/1984 | Yamamoto et al. | 148/545 |
| 4,880,477 | 11/1989 | Hayes et al. | 148/545 |
| 5,028,281 | 7/1991 | Hayes et al. | 148/321 |
| 5,043,028 | 8/1991 | Kovacs et al. | 148/321 |
| 5,139,579 | 8/1992 | Kovacs et al. | 148/545 |
| 5,246,510 | 9/1993 | Kovacs et al. | 148/612 |

FOREIGN PATENT DOCUMENTS

| | | | |
|---|---|---|---|
| 1318837 | 6/1993 | Canada | 148/11 |
| 2097151 | 12/1993 | Canada | C21D 5/00 |
| 62-256913 | 11/1987 | Japan | 148/545 |
| 2109814 | 6/1983 | United Kingdom | C21D 5/00 |
| 2112811 | 7/1983 | United Kingdom | 148/545 |

OTHER PUBLICATIONS

Abstract for JP 51008107 A dated Jan. 22, 1976 1 page.
Abstract for JP 59074216 A dated Apr. 26, 1984 1 page.
Abstract for JP 60125349 A dated Jul. 4, 1985 1 Page.
Abstract for JP 1108342 A dated Apr. 25, 1989 1 Page.
Abstract Class for JP 2118021 A dated May 2, 1990 1 Page.

*Primary Examiner*—Deborah Yee
*Attorney, Agent, or Firm*—Synnestvedt & Lechner

[57] ABSTRACT

A cast iron component, eg a camshaft, has a wear-resistant layer formed on at least one surface portion thereof, said layer being rich in primary carbides. The cast iron surrounding the carbides and in the remainder of the component has a structure which is substantially ausferritic. A method of manufacturing a component is also claimed.

8 Claims, No Drawings

CAST IRON COMPONENTS AND METHOD OF MAKING

This invention is concerned with cast iron components. In particular, the invention is concerned with cast iron components which have a wear-resistant layer on at least one surface portion thereof. The invention is applicable, for example, to components which are subjected to rolling contact stress or to sliding stress. For example, the invention is applicable to valve train components of an internal combustion engine, eg camshafts, individual cams which are subsequently assembled on a shaft, tappets or rockers.

It is well-known for a cast iron component to have a pearlitic and/or ferritic structure. The structure may contain graphite flakes (in which case it is known as "grey iron"), or spherical particles or nodules of graphite (in which case it is known as "ductile iron") . It is also well-known (see eg U.S. Pat. No. 5,122,204) to cast such a component so that it has a wear-resistant layer on a surface portion thereof, the layer being rendered wear-resistant by being rich in primary iron carbides. This is achieved by a method known as "chill casting" in which, the component is cast in a mould which is primarily formed from sand but incorporates at least one metal chill, with said surface portion being solidified against said chill so that the layer cools rapidly. Such a component has a surface layer with a pearlitic and/or ferritic structure which is rich (eg 60% or more by volume) in primary iron carbides, and the remainder of the component has a pearlitic and/or ferritic structure containing graphite flakes or nodules. For example, camshafts for internal combustion engines are conventionally made by this method. Such camshafts comprise an elongated shaft on which a plurality of valve-operating cams are disposed, with the cams being orientated at various orientations which depend on the sequence of valve operation required. Such camshafts may also incorporate other features. In such camshafts, the surfaces of the cams which will engage other components so that they are subject to sliding contact stress, when the camshaft is in service, are cast against the metal chills, thereby giving them a primary carbide-rich surface layer which is wear resistant because of the high hardness of this structure.

Cast iron camshafts of the type described above have cam surfaces with good "scuff-resistance" so that they are suitable for sliding contact stress situations. However, their ability to withstand the high bending stresses which are applied in service is, in some cases, insufficient for modern high speed engines. Also, such camshafts can be subject to "pitting fatigue" in which the formation of subsurface cracks results in portions of the working surface breaking away leaving relatively large craters. Both these problems are caused by the limited strength of the pearlitic and/or ferritic structure.

It is an object of the present invention to provide a cast iron component with a wear-resistant surface layer and increased strength.

The invention provides a cast iron component having a wear-resistant layer formed on at least one surface portion thereof, said layer being rich in primary carbides, wherein the cast iron surrounding the carbides and in the remainder of the component has a structure which is substantially ausferritic.

A component according to the invention combines a wear-resistant surface layer with the strength of an ausferritic structure. A component according to the invention excludes graphite from the working surface by the use of chilling so that the component is less likely to be prone to surface pitting when used in a rolling contact situation. Furthermore, the carbide plates in the working surface act to distribute loads and are thermally stable so that scuffing is reduced particularly in sliding contact situations. Thus, a component according to the invention combines scuffing resistance with enhanced fatigue strength, thereby making it suitable to withstand mixed sliding and rolling contact, which is often encountered in service against a roller follower.

In a component according to the invention, said layer has a thickness of 5 to 10 mm.

Preferably, in a component according to the invention, said layer comprises at least 60% by volume of said primary carbides.

It is well-known (see eg U.S. Pat. No. 4,880,477) that it is possible to convert a pearlitic and/or ferritic structure into an austenitic structure by a heat treatment and by further heat treatment to "austemper" the structure so that it is converted into an "ausferritic" structure which is a bainitic ferrite/high-carbon austenite structure. This structure is very strong and gives properties which surpasses those of many steels. The process comprises maintaining the cast component at a high temperature (in the austenite phase field) until the pearlitic and/or ferritic structure is converted into an austenitic structure with a homogeneous carbon content; quenching the casting to a lower temperature (well above the martensite start temperature) to prevent formation of pearlite and retain an austenitic structure; and maintaining the component at the lower temperature to convert the retained austenite into ausferrite. The temperatures and times employed during the austempering process determines the mechanical properties of the material by influencing the volume fractions of high carbon austenite and bainitic ferrite present, as well as the quantity of retained austenite (which converts to martensite on cooling) and the size and morphology of the carbides formed. This technology is conventionally applied to components which require high fatigue strength such as gear teeth. However, it has been proposed (U.S. Pat. No. 4,880,477 afore-mentioned) that a component, such as a camshaft, should be formed entirely from austempered cast iron. It has also been proposed (U.S. Pat. No. 5,246,510) that a cast iron part should have surface layers only thereof austempered.

The austempering process described above has not hitherto been considered to be suitable for use with chilled components, such as camshafts, which have surface layers rich in primary carbides, because the austempering process would be expected to dissolve the carbides into the remainder of the structure. However, the Applicants have found that it is possible by carefully controlling the process to substantially avoid dissolving of the carbides.

The invention also provides a method of manufacturing a component, the method comprising forming an iron casting which has a pearlitic and/or ferritic structure, the casting having at least one surface portion which is rich in primary carbides, the casting being cast in a mould which incorporates at least one metal chill with said surface portion being solidified against said chill, wherein the method also comprises maintaining the casting in the temperature range between 750° and 950° C. for a period which is long enough to ensure that substantially all of said pearlitic and/or ferritic structure is converted to an austenitic structure but not so long that said primary carbides are dissolved, then cooling said casting from said temperature range to a temperature in the range between 200° and 400° C. by a controlled cooling process in which the casting is cooled rapidly enough to prevent the austenitic structure from converting back into a pearlitic and/or ferritic structure but not so rapidly that the casting cracks, and then maintaining the casting in the temperature range between 200° and 400° C. for a period long enough to ensure that substantially all of the austenitic structure is converted into an ausferritic structure.

In a method according to the invention, the austempering process described above is successfully applied to chilled cast iron components which retain their primary carbide-rich surface layers. This is achieved by converting to austenite at a lower temperature than in conventional processes so that primary carbides are not dissolved. By the controlled cooling, cracking is avoided. The result is a component which has the advantages of a hard scuff-resistant surface layer and of an underlying structure of improved strength. The invention can be utilised with grey cast iron in which case the underlying material contains flake graphite. The invention can also be utilised with ductile cast iron in which case the underlying material contains nodular graphite. A method according to the invention is suitable for use in manufacturing valve train components such as camshafts, individual cams, tappets and rockers, and other components which require fatigue-resistance and scuff-resistant surfaces.

In a method according to the invention, said casting may be maintained between 750° and 950° C. for 0.5 to 2.5 hours, depending on the size and shape of the component. Said casting may be maintained between 750° and 950° C. in a neutral atmosphere, such as a nitrogen atmosphere. Preferably, the component is maintained below 880° C., ie in the range between 750° and 880° C.

In order to more closely control the cooling, in a method according to the invention, the controlled cooling of the casting may take place in a salt bath.

In a method according to the invention, the casting may be maintained in the temperature range between 200° and 400° C. in a salt bath.

There now follow detailed descriptions of two examples of components, specifically camshafts, and their methods of manufacture which are illustrative of the invention.

In the first illustrative example, a component was formed from a grey cast iron having a composition of: carbon 3.1–3.9%, silicon 1.5–2.5%, sulphur 0.15% max., phosphorus 0.2% max., manganese 0.5–1%, chromium up to 1.2%, nickel up to 0.6%, molybdenum up to 0.7%, copper up to 0.9%, and the balance iron, all percentages being by weight.

The component was cast in a conventional chill casting process to give an iron casting which had a pearlitic and/or ferritic structure with its cam surface portions rich in primary carbides (approximately 60% by volume).

Next, the casting was heated to and maintained at a temperature of 801° C. for two hours. This period was long enough to ensure that substantially all of said pearlitic and/or ferritic structure was converted to an austenitic structure but was not so long that said primary carbides were dissolved. The heating took place in an enclosed furnace which contained a nitrogen atmosphere. Thus, at this stage, an austenitic structure having a surface layer rich in primary carbides was present.

As a comparison, conversion to austenite was carried out on a number of similar camshafts at various temperatures and the percentage of primary carbides in the surface layer cast against a chill was measured. The results were as follows:

At 927° C., the percentage of carbides was 10%, at 899° C. the percentage was 20%, at 871° C. the percentage was 30%, at 843° C. the percentage was 40%, at 816° C. the percentage was 50%, at 801° C. (the first illustrative example) the percentage was 60%, and at 788° C. the percentage was 60% but there was insufficient conversion to austenite. This indicates that there exists "a window of opportunity" in the possible temperatures within which the primary carbides are not significantly dissolved but austenite is formed. In many cases, this window occurs at about 800° C., for example between 790° C. and 810° C.

Next, the casting was cooled from 801° C. to 380° C. by a controlled cooling process. Specifically, the casting was placed in a salt bath (a 50/50 mixture of potassium nitrate and sodium nitrate) and its temperature lowered at a controlled rate. In the cooling process, the casting was cooled rapidly enough to prevent the austenite from converting back into pearlite and/or ferrite but not so rapidly that the casting cracked.

Next, the casting was maintained at 380° C. for two hours. This period was long enough to ensure that substantially all of the austenite was converted into ausferrite. The completed component retained the carbide rich surface layers.

In the first illustrative example, the camshaft formed was machined to improve the surface quality (as is conventional) before the heat treatment described above but, if desired, the machining could be performed after the heat treatment.

A camshaft manufactured according to the first example was found to have carbide volumes in the cam surfaces thereof which were normal, ie approximately 60% by volume, for camshafts which had not been heat treated. The hardness of the material 2 mm below the surface of the cam surface was measured at 45–50 HRc.

In the second illustrative example, a ductile iron composition was used instead of grey iron but otherwise the second illustrative example was identical to the first illustrative example. In the second illustrative example, the composition was: carbon 3.8–4.0%, silicon 1.2–1.8%, phosphorus 0.15% max., sulphur 0.2% max., manganese up to 0.6%, magnesium 0.025–0.06%, chromium up to 0.2%, copper up to 1.5%, molybdenum up to 0.6%, tin up to 0.1%, nickel up to 0.4%, and the balance iron, all percentages being by weight. A camshaft according to the second illustrative example was found to have carbide volumes in the cam surfaces thereof which were normal, ie approximately 60% by volume, for camshafts which had not been heat treated. The hardness of the material 2mm below the surface of the cam surface was measured at 46–48 HRc.

Camshafts according to the first and the second illustrative examples were compared with conventional chilled grey and ductile iron camshafts in wear tests in which the camshafts were run against sliding tappets. In each case the test lasted 100 hours. With a contact stress of 850 MPa, the chilled grey iron camshaft was found to exhibit visible pitting as was the chilled ductile iron camshaft. At the higher contact stress of 1100 MPa the camshafts made by the first and the second illustrative methods exhibited light polishing only with no visible pitting.

The camshafts were also subjected to a tensile stress test to assess their strength. A conventional grey cast iron camshaft withstood 280 MPa. A camshaft manufactured according to the first illustrative method withstood 350 MPa. A conventional ductile cast iron camshaft withstood 620 MPa. A camshaft manufactured according to the second illustrative method withstood 850 MPa.

We claim:

1. A cast iron component having a wear-resistant layer formed on at least one surface portion thereof, said layer being rich in primary carbides, wherein the cast iron surrounding the carbides and in the remainder of the component has a structure which is substantially ausferritic.

2. A component according to claim 1, wherein said layer has a thickness of 5 to 10 mm.

3. A component according to claim 1, wherein said layer comprises at least 60% by volume of said primary carbides.

4. A method of manufacturing a component, the method comprising forming an iron casting which has a pearlitic and/or ferritic structure, the casting having at least one surface portion which is rich in primary carbides, the casting being cast in a mould which incorporates at least one metal chill with said surface portion being solidified against said chill, wherein the method also comprises maintaining the casting in the temperature range between 750° and 950° C. for a period which is long enough to ensure that substantially all of said pearlitic and/or ferritic structure is converted to an austenitic structure but not so long that said primary carbides are dissolved, then cooling said casting from said temperature range to a temperature in the range between 200° and 400° C. by a controlled cooling process in which the casting is cooled rapidly enough to prevent the austenitic structure from converting back into a pearlitic and/or ferritic structure but not so rapidly that the casting cracks, and then maintaining the casting in the temperature range between 200° and 400° C. for a period long enough to ensure that substantially all of the austenitic structure is converted into an ausferritic structure.

5. A method according to claim 4, wherein said casting is maintained between 750° and 950° C. for 0.5 to 2.5 hours.

6. A method according to claim 5, wherein said casting is maintained between 750° and 950° C. in a nitrogen atmosphere.

7. A method according to claim 4, wherein the controlled cooling of the casting takes place in a salt bath.

8. A method according to claim 4, wherein the casting is maintained in the temperature range between 200° and 400° C. in a salt bath.

* * * * *